US005592926A

United States Patent [19]

Miyata et al.

[11] Patent Number: 5,592,926

[45] Date of Patent: Jan. 14, 1997

[54] METHOD OF DETECTING MISFIRE OF ENGINE IGNITION SYSTEM AND DEVICE FOR CARRYING OUT THE SAME

[75] Inventors: Shigeru Miyata; Noriaki Kondo; Hiroshi Inagaki, all of Nagoya, Japan

[73] Assignee: NGK Spark Plug Co., Ltd., Nagoya, Japan

[21] Appl. No.: 356,737

[22] Filed: Dec. 15, 1994

[30] Foreign Application Priority Data

| | | | |
|---|---|---|---|
| Dec. 17, 1993 | [JP] | Japan | 5-317210 |
| Aug. 31, 1994 | [JP] | Japan | 6-205834 |
| Oct. 7, 1994 | [JP] | Japan | 6-243585 |

[51] Int. Cl.[6] ..... F02P 17/00

[52] U.S. Cl. ..... 123/630; 123/656; 324/388; 324/399

[58] Field of Search ..... 123/479, 481, 123/630, 643, 655, 656, 647; 73/116, 117.2, 117.3; 324/378, 380, 388, 399

[56] References Cited

U.S. PATENT DOCUMENTS

| | | | |
|---|---|---|---|
| 5,144,936 | 9/1992 | Murata et al. | 123/630 X |
| 5,283,527 | 2/1994 | DeBiasi | 123/643 X |
| 5,400,760 | 3/1995 | Miyata et al. | 123/630 |

*Primary Examiner*—Tony M. Argenbright
*Attorney, Agent, or Firm*—Foley & Lardner

[57] ABSTRACT

A method of detecting a misfire of an ignition system for an internal combustion engine is provided. By the method, after completion of spark discharge of a spark plug, a high tension pulse which is not so high as to cause spark discharge is applied to each spark plug by way of a reverse current preventing diode and a secondary winding of an ignition coil or by way of a reverse current preventing diode and a leakage preventing diode for preventing ingress of an ignition high voltage. Misfire at each cylinder is detected on the basis of a voltage attenuation characteristic at a passing side terminal of the reverse current preventing diode. A device for carrying out the above method is also provided.

12 Claims, 11 Drawing Sheets

METHOD OF DETECTING MISFIRE OF ENGINE IGNITION SYSTEM AND DEVICE FOR CARRYING OUT THE SAME

BACKGROUND OF THE INVENTION

1. Field of the Invention

The present invention relates to a method of selecting a misfire of an ignition system for a multi-cylinder internal combustion engine and a device for carrying out the same.

2. Description of the Prior Art

An ignition system of the type having a distributor is shown in FIG. 10. The distributor type ignition system includes an ignition coil 901, a battery 903 and a power transistor 904 both connected to a primary winding 902 of the ignition coil 901, an engine control unit (ECU) 905 for supplying an ignition signal to the power transistor 904, a distributor 907 for distribution of a high voltage induced in a secondary winding 906, and spark plugs 908~911 connected to side electrodes of the distributor 907.

A single-ended distributorless ignition system shown in FIG. 11 is also known and used with a view to reducing the radio noise interference and increasing the reliability. The ignition system shown in FIG. 11 is of the type for use in a two-cylinder engine and consists of radio coils 920 and 921, power transistors 924 and 925 for intermittently allowing battery current to flow to primary windings 922 and 923 of the ignition coils 920 and 921, an engine control unit (ECU) 926 for sending an ignition signal to the power transistors 924 and 925 and spark plugs 927 and 928.

In the distributor type ignition system shown in FIG. 10, it has heretofore been practiced to install thereon a misfire detecting device which consists of a voltage dividing circuit made up of coupling condensers 914, 915, 916 and 917 of a small capacity, a condenser 918 of a relatively large capacity and a resistor 919, and a misfire detecting circuit 913, and detects a misfire of the spark plug at each cylinder on the basis of the attenuation characteristic of the divided voltage.

In the single-ended distributorless ignition system shown in FIG. 11, it has heretofore been practiced to install thereon a misfire detecting device which consists of a voltage divider made up of coupling condensers 929 and 930 of a small capacity, a condenser 931 of a relatively large capacity and a resistor 932, and a misfire detecting circuit 933, and detects a misfire of the spark plug at each cylinder on the basis of the attenuation characteristic of the divided voltage.

The misfire detecting device for installation on the distributor type ignition system requires the coupling condensers 914, 915, 916 and 917 of the small capacity, of the same number as the cylinders and a fixing device for fixing the condensers to high-tension codes, thus increasing the cost. The misfire detecting device for installation on the distributorless ignition system also requires the coupling condensers 929 and 930 of the small capacity, of the same number as the cylinders.

SUMMARY OF THE INVENTION

In accordance with the present invention, there is provided a novel and improved method of detecting a misfire of an ignition system for inducing an ignition high voltage in a secondary winding of an ignition coil by intermittently supplying primary current to a primary winding of the ignition coil and applying the ignition high voltage to spark plugs provided to respective cylinders of a multi-cylinder internal combustion engine. The method comprises the steps of applying, after completion of spark discharge, a high tension pulse which is not so high as to cause spark discharge to each spark plugs by way of a reverse current preventing diode and the secondary winding or by way of a reverse current preventing diode and a leakage preventing diode for preventing ingress of an ignition high voltage, and detecting a misfire at each cylinders on the basis of a voltage attenuation characteristic at a passing side end of the reverse current preventing diode.

With the above method, in case of a distributorless ignition system, a high tension pulse which is not so high as to cause spark discharge is applied to each spark plugs by way of a reverse current preventing diode and a secondary winding. In case of a distributor type ignition system, a high tension pulse which is not so high as to cause spark discharge is applied to each spark plugs by way of a reverse current preventing diode and a secondary winding or a reverse flow preventing diode and a leakage preventing diode for preventing ingress of an ignition high voltage. When there is not caused any misfire of the ignition system, i.e., there is caused normal combustion at each cylinders, the electrical resistance between the center electrode and the outer electrode of the corresponding spark plug becomes lower, so the high tension pulse attenuates in an early time and also the voltage at the passing side end of the reverse current preventing diode attenuates in an early time. When a misfire of the ignition system occurs, the electrical resistance does not become lower, so the speed of attenuation of the voltage at the passing side end of the reverse current preventing diode is low.

According to another aspect of the present invention, there is provided a misfire detecting device for a single-ended distributorless ignition system having ignition coils of the same number as cylinders of an engine and each having a primary winding and a secondary winding independent from the primary winding, primary current supplying means for supplying battery current to the primary windings of the ignition coils intermittently and in turn, and spark plugs provided to the respective cylinders of the engine and each connected at a center electrode side to one end of the secondary winding and grounded at an outer electrode side to a cylinder side. The misfire detecting device comprises pulse generating means for generating a high tension pulse during the time after completion of spark discharge of one of the spark plugs and before application of an ignition high voltage to another of the spark plugs which is to discharge next, reverse current preventing diodes of half the number of the ignition coils and each connected at a cathode to a junction between the other ends of each secondary windings of the two ignition coils which cause ignition at a phase difference of 360° with respect to an engine crank angle and at an anode to an output end of the pulse generating means, voltage dividing means of half the number of the ignition coils for dividing a voltage at a cathode side of each of the diodes to obtain a divided voltage thereat, and detecting means for detecting a misfire of the ignition system on the basis of an attenuation characteristic of the divided voltage after application of the high tension pulse.

With the above device, when the primary current supplying means supplies battery current to the primary windings of each ignition coils intermittently and in turn, a high voltage is induced in the secondary windings in turn. Spark discharge of the spark plugs is thus caused in turn. The pulse generating means produces a high tension pulse which is not so high as to cause spark discharge during the time after completion of any one of the spark plugs and before another spark plug to perform spark discharge next starts performing spark discharge. The high tension pulse is applied to the other end of each secondary winding of the two ignition coils by way of the reverse current preventing diode (of half the number of the ignition coils) and then from one ends of the secondary windings to the center electrodes of each spark plugs. The voltage dividing means divides the total voltage at the cathode side of each diodes so that a divided voltage is within an allowable input range of the misfire detecting means. For example, after completion of normal firing, the electrical resistance between the center electrode and the outer electrode of the spark plug in the corresponding cylinder becomes lower, so the high tension pulse flow rapidly from the center electrode to the outer electrode, allowing the divided voltage to attenuate in an early time. On the other hand, when a misfire occurs, the electrical resistance of the spark plug in the corresponding cylinder does not become lower, so the speed of attenuation of the divided voltage is low. By the above principle, the detecting means determines whether a misfire occurs at each cylinders.

According to a further aspect of the present invention, there is provide a misfire detecting device for an ignition system. The device comprises an ignition coil having a primary winding and a secondary winding independent from the primary winding, primary current supplying means for intermittently supplying battery current to the primary winding of the ignition coil, a distributor connected at a rotor side to one end of the secondary winding, a spark plug provided to a cylinder of an engine and connected at a center electrode side to a side electrode of the distributor and grounded at an outer electrode side to a cylinder side, pulse generating means for generating a high tension pulse which is not so high as to cause spark discharge just after completion of spark discharge of the spark plug, reverse current preventing diodes for applying the high tension pulse to the other end of the secondary winding, voltage dividing means for dividing a voltage at the other end of the secondary winding to obtain a divided voltage thereat, and detecting means for detecting a misfire on the basis of an attenuation characteristic of the divided voltage after application of the high tension pulse.

With the above misfire detecting device, when the primary current supplying means supplies intermittently battery current to the primary winding of the ignition coil, a high voltage is induced in the secondary winding. The high voltage induced in the secondary winding passes from the rotor side through the side electrode and is applied to a spark plug installed in a cylinder at a firing stroke, so the spark plug performs spark discharge. The pulse generating means produces a high tension pulse which is not so high as to cause spark discharge just after completion of spark discharge of the spark plug. The high tension pulse is applied through the reverse current preventing diode to other end of the secondary winding, then transmitted to one end of the secondary winding and the rotor side electrode of the distributor, and is applied to the center electrode of the spark plug having completed spark discharge. The voltage dividing means divides the total voltage at the other end side of the secondary winding in such a manner that the divided voltage is within the allowable input range of the misfire detecting means. For example, after occurrence of normal combustion in a cylinder, i.e., after normal firing in a cylinder, the electrical resistance between the center electrode and the outer electrode of the spark plug becomes lower, so the voltage at the other end side of the secondary winding attenuates in an early time. In case of occurrence of a misfire at a cylinder, the electrical resistance between the center electrode and the outer electrode of the spark plug is maintained high, so attenuation of the potential is delayed. By this principle, the detecting means detects occurrence of a misfire at a cylinder on the basis of the divided voltage attenuation characteristic.

According to a further aspect of the present invention, there is provided a device for detecting a misfire of an ignition system including an ignition coil having a primary winding and a secondary winding, primary current supplying means for intermittently supplying battery current to the primary winding of the ignition coil, a distributor connected at a rotor side to one end of the secondary winding, and a spark plug connected at a center electrode side to a side electrode of the distributor and grounded at an outer electrode side to a cylinder side. The device comprises a first reverse current preventing diode disposed between the one end of the secondary winding and a rotor side of the distributor, pulse generating means for generating a high tension pulse which is not so high as to cause spark discharge just after completion of spark discharge of the spark plug, a second reverse current prevent diode and leakage preventing diode for applying the high tension pulse to the distributor side of the distributor, voltage dividing means for dividing a voltage at a junction between the second reverse current preventing diode and the leakage preventing diode to obtain a divided voltage thereat, and a misfire detecting means for detecting a misfire on the basis of an attenuation characteristic of the divided voltage after application of the high tension pulse.

With the above device, when the primary current supplying means supplies battery current to the primary winding of the ignition coil intermittently, a high voltage is induced in the secondary winding. The high voltage induced in the secondary winding of the ignition coil is transferred through the first reverse current preventing diode to the side electrode of the distributor and applied to the center electrode of the spark plug installed in a cylinder at a firing cycle to make it perform spark discharge. The pulse generating means produces a high tension pulse which is not so high as to cause spark discharge just after completion of spark discharge of the spark plug. The high tension pluse is applied through the second reverse current preventing diode and the leakage peventing diode and further through the rotor side electrode of the distributor to the center electrode of the spark plug having completed spark discharge. The voltage dividing means divides the total voltage at the junction between the second reverse current preventing diode and the leakage preventing diode in such a manner that the divided voltage is included within the allowable input range of the misfire detecting means. For example, after occurrence of normal combustion in a cylinder, i.e., after normal firing in a cylinder, the electrical resistance between the center electrode and the outer electrode of the spark plug becomes lower, so the potential at the junction attenuates in an early time. In case of occurrence of a misfire at a cylinder, the electrical resistance between the center electrode and the outer electrode of the spark plug is maintained high, so attenuation of the potential is delayed. By this principle, the detecting means detects occurrence of a misfire of the spark plug at each cylinder on the basis of the divided voltage attenuation characteristic.

According to a further aspect of the present invention, the voltage dividing means comprises a condenser voltage dividing circuit constructed of a capacitor of a relatively small capacity and a capacitor of a relatively large capacity which are connected in series.

With the above voltage dividing means, voltage division is performed so that the divided voltage to be detected is a fraction of the total voltage corresponding to the capacity ratio of the capacitor of the relatively small capacity to the capacitor of the relatively large capacity and is included within an allowable input range of the misfire detecting means.

According to a further aspect of the present invention, the voltage dividing means comprises a condenser voltage dividing circuit constructed of a first capacitor of a relatively small capacity electrically connected at one end to a junction between the other end of the secondary winding or the second reverse current preventing diode and the leakage preventing diode, and a second capacitor of a relatively large capacity connected at one end to the other end of the first capacitor and grounded at the other end, wherein the first and second capacitors are installed on one common insulation substrate.

With the above voltage dividing means, the condenser voltage dividing circuit can be arranged on a signal substrate, and the total voltage is divided in such a manner that the potential at the junction between the first and second capacitors is a fraction of the total voltage corresponding to the capacity ratio of the capacitor of the relatively small capacity to the capacitor of the relatively large capacity and is included within an allowable input range of the misfire detecting means.

The above method and device are effective for solving the above noted problems inherent in the prior art device.

It is accordingly an object of the present invention to provide a novel and improved method of detecting a misfire of an ignition system for a multi-cylinder internal combustion engine which makes it possible to take a voltage for detection of a misfire out of the ignition system with ease.

It is a further object of the present invention to provide a novel and improved device of detecting a misfire of an ignition system for an internal combustion engine which makes it possible to utilize voltage dividing means which is simpler in structure as compared with the prior art means.

DETAILED DESCRIPTION OF THE PREFERRED EMBODIMENTS

Figure 1:
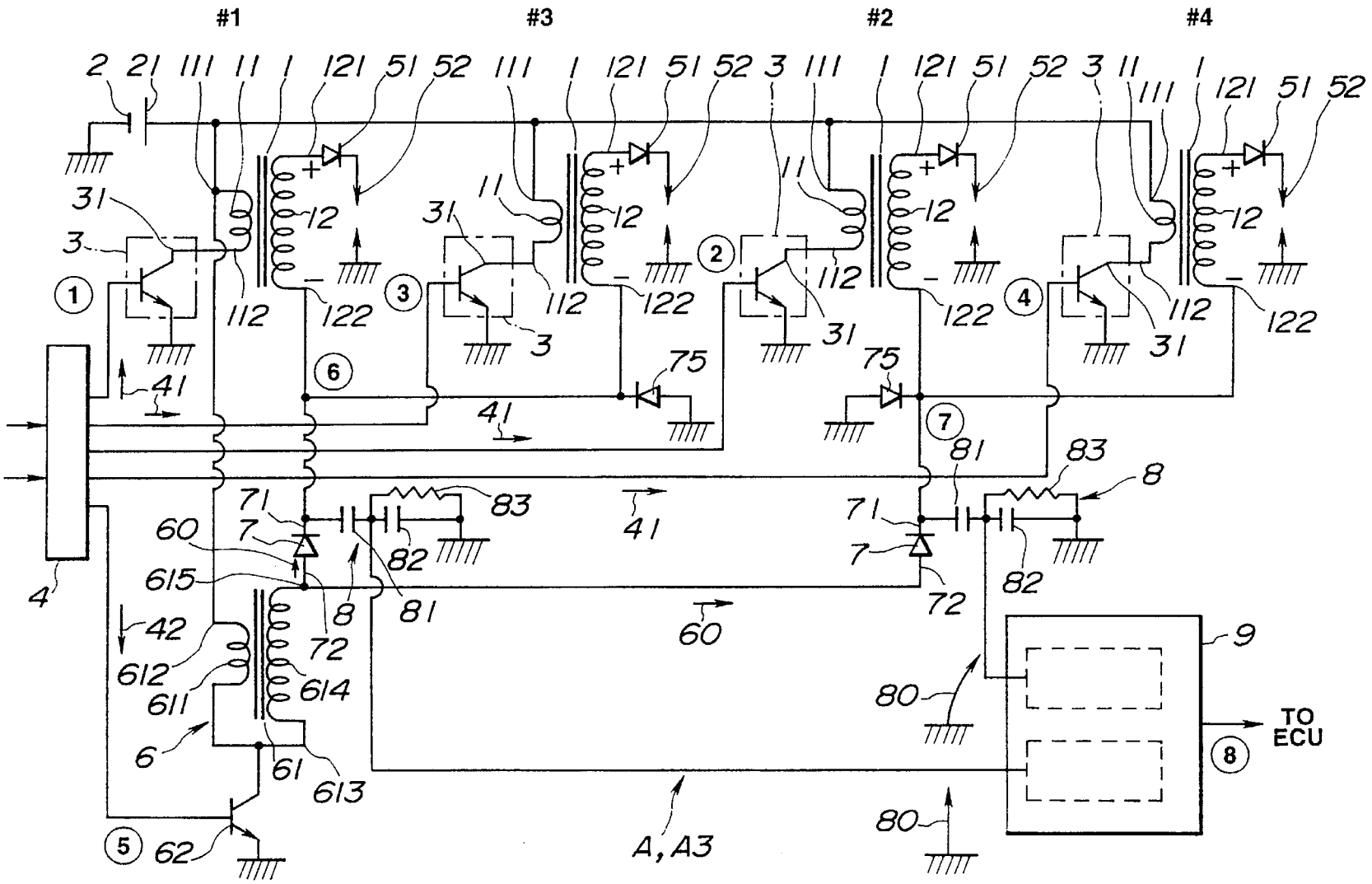
FIG. 1 is a diagram of a single-ended distributorless ignition system equipped with a misfire detecting device according to a first or third embodiment of the present invention.

Referring first to FIGS. 1, a distributorless ignition system having incorporated therein a misfire detecting device according to a first embodiment of the present invention is generally indicated by "A" and shown as being of the type for use in a four-cylinder engine. The ignition system "A" includes ignition coils 1, a battery 2 and power transistors 3 connected to respective primary windings 11 of the ignition coils 1, an engine control unit (ECU) 4 for delivering an ignition signal 41 to the respective power transistors 3, spark plugs 52 for connection to secondary windings 12 of the ignition coils 1, a pulse generating circuit 6 for producing a high tension pulse 60, diodes 7 for connection between a secondary terminal 615 and respective negative terminals 122, voltage dividing circuits 8 for dividing the voltage at the cathode 71 sides, and a misfire detecting circuit 9 for receiving a divided voltage (i.e., a fraction of the total voltage) 80.

Each of the ignition coils 1 (single-ended DLI type) is composed of hundreds of turns of the primary winding 11 and tens of thousands of turns of a secondary winding 12 which are wound on an iron core. The iron on core is formed from a plurality of thin silicon steel plates which are stacked one upon another. The windings are placed in a casing filled with resin (epoxy or the like). Each ignition coil 1 has, on the top face of the casing, primary terminals 111 and 112, a secondary high tension positive terminal 121, and a secondary negative terminal 122 which are independent from each other.

The primary terminal 111 of each of the ignition coils 1 is connected to a positive terminal 21 of the battery 2, whilst a primary terminal 112 is connected to a collector 31 of the power transistor 3.

Further, the secondary negative terminals 122 of the ignition coils 1 for the #1 and #3 cylinders are connected to each other, whilst the secondary negative terminals 122 of the ignition coils 1 for the #2 and #4 cylinders are connected to each other, that is, two ignition coils 1 which ignite at a phase difference of 360° with respect to an engine crank angle are connected to each other.

Further, the secondary high tension positive terminal 121 of each ignition coil 1 is connected to a center electrode of each spark plug 52 by using a high tension cable and by interposing therebetween an erroneous ignition preventing diode 51. Diodes 75 are provided with a view to preventing an excessively high voltage from being applied across the secondary negative terminals 122. However, such diodes can be omitted though the provision thereof is desirable.

The power transistors 3 for allowing battery current to flow intermittently and in turn through the primary windings 11 of each ignition coils 1 are put into an ON/OFF condition on the basis of an ignition signal 41 delivered from the engine control unit 4 and make the secondary windings 12 develop a high voltage of several tens kilovolts when operated to change from the ON condition to the OFF condition.

The engine control unit 4 determines an optimum ignition timing on the basis of engine speed, coolant temperature, a signal from a cam position sensor, etc. and delivers an ignition signal 41 to the power transistors 3 so that spark discharge is caused at the optimum ignition timing. Further, the engine control unit 4 determines, on the basis of the determined optimum ignition timing, a timing for delivering a high tension pulse 60 and delivers a pulse generation instructing signal 42 to the pulse generating circuit 6.

In this embodiment, "primary current supplying means" is constituted by the engine control unit 4 and the power transistor 3.

The spark plugs 52 are installed on the respective engine cylinders one by one and adapted to fire or perform spark discharge when receiving a positive high voltage at a center electrode during a compression stroke.

The pulse generating circuit 6 in this embodiment is composed of a coil 61 connected at a primary contact 612 of a primary winding 611 to a positive terminal 21 of the battery 2, and a power transistor 62 connected at a collector to an internal connecting terminal 613. The power transistor 62 is biased off or turned on in response to the pulse generation instructing signal 42 delivered from the engine control unit 4 and causes a high voltage (about 3 kV in this embodiment) which is not causative of spark discharge, to be produced at a secondary terminal 615 of a secondary winding 614 when biased off from a turned on condition.

Diodes 7, which are connected at each anodes 72 to the secondary terminal 615 (i.e., output end of the pulse generating circuit 6) and at each cathode 71 to the secondary negative terminals 122 or to a junction between the other ends 122 of the secondary windings 12 of the ignition coils 1, are reverse current preventing, high withstand voltage diodes for applying a positive polarity high tension pulse 60 delivered from the pulse generating circuit 6 to the secondary negative terminals 122 whilst preventing the high voltage for ignition of the spark plugs 52 from flowing back to the pulse generating circuit 6.

A potential dividing circuit 8 is composed of a small capacity condenser 81 (about 3 pF) connected at an end to the cathode 71 of the diode 7 and a large capacity condenser 82 (about 900 pF) connected at an end to the other end of the condenser 81 and grounded at the other end, and a resistor 83 of a high resistance connected in parallel to the condenser 82, whereby the total voltage at the secondary negative terminal 122 is divided in such a manner that the divided voltage is about 1/300 of the total voltage.

By the capacity ratio of the condensers 81 and 82, the high voltage is divided, and a divided voltage 80 is supplied to the misfire detecting circuit 9.

The misfire detecting circuit 9 detects firing at each engine cylinders provided with the spark plugs 52 on the basis of the attenuation characteristic of each divided voltage 80. In the meantime, when the combustion is normal, i.e., there is not caused any misfire, the electrical resistance between the center electrode and the outer electrode of the corresponding spark plug becomes lower, so the corresponding divided voltage 80 attenuates rapidly or in an early time. However, when a misfire occurs, the electrical resistance between the center electrode and the outer electrode is maintained high, the corresponding divided voltage attenuates gradually or slowly.

The reason why the number of the diodes 7, the number of the potential dividing circuits 8 and the number of the combustion condition detecting circuits 9 respectively utilized are half of the number of the ignition coils 1, i.e., 2 will now be described hereinbelow.

Figure 3:
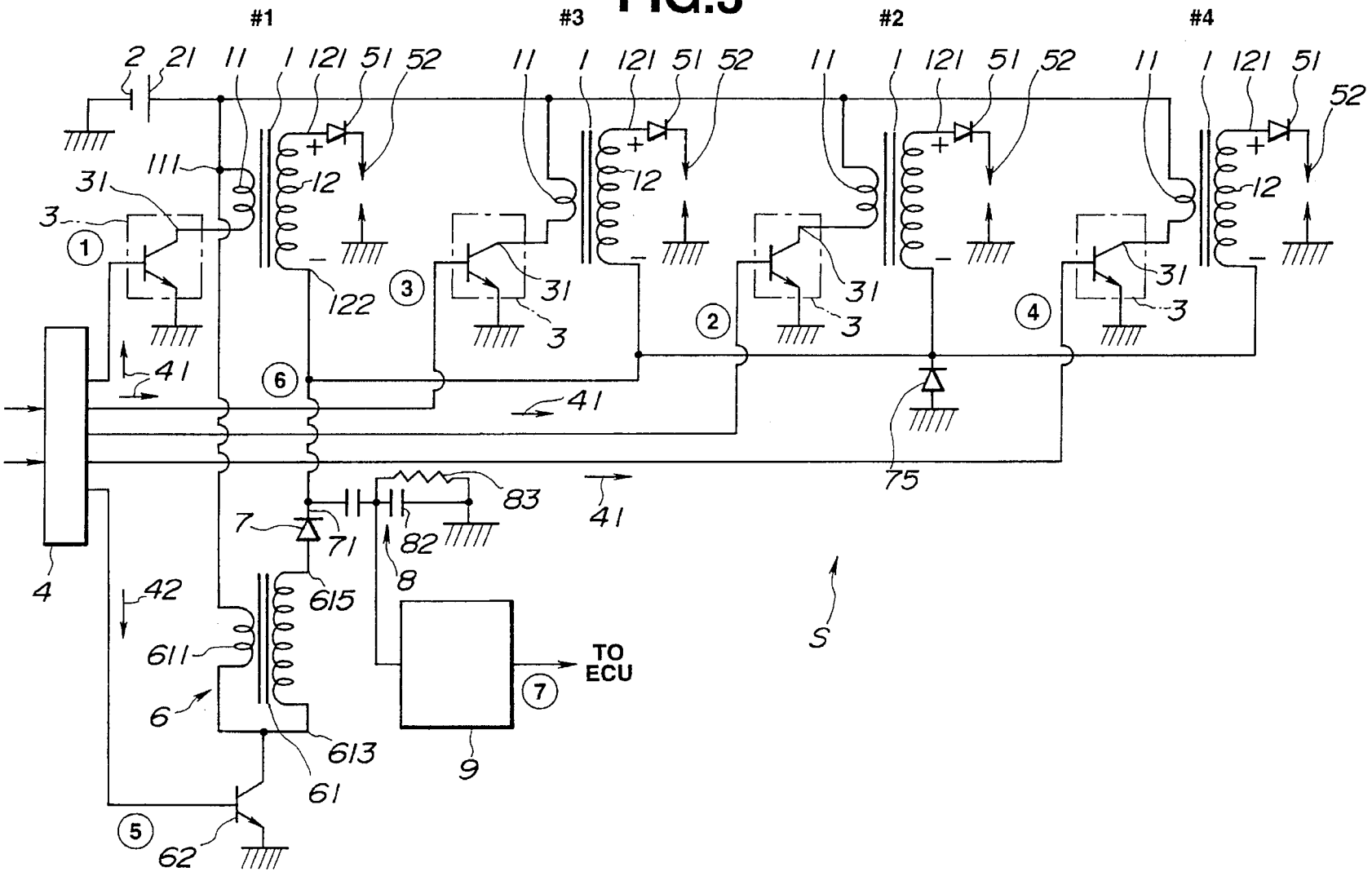
FIG. 3 is a diagram of a comparative single-ended distributorless ignition system.
Figure 4:
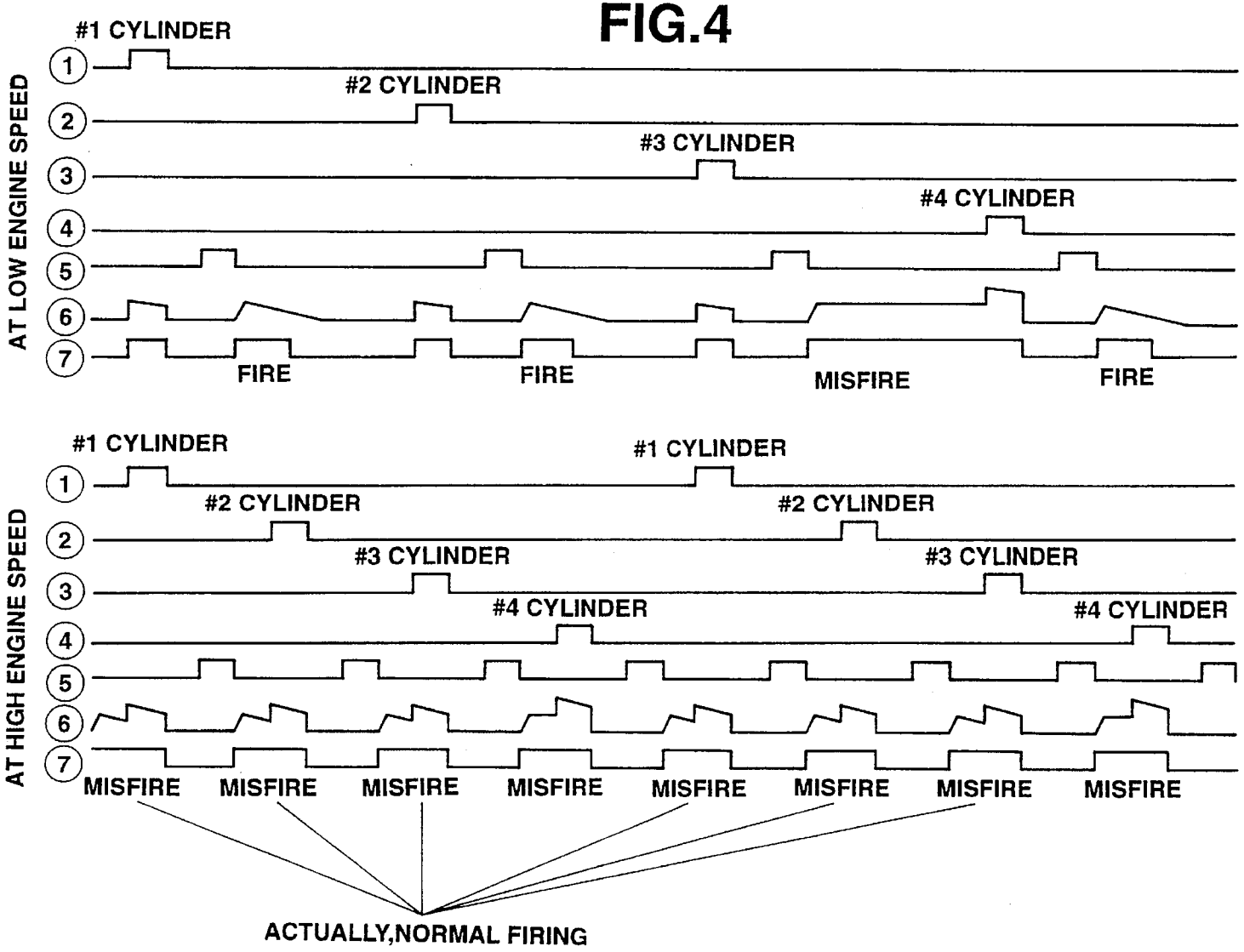
FIG. 4 is a chart of output waveforms at various portions of the single-ended distributorless ignition system of FIG. 3.

FIG. 3 shows a comparative example of a single-ended distributorless ignition system "S" equipped with a misfire detecting device. In the ignition system "S", the diode 7, the voltage dividing circuit 8 and the misfire detecting circuit 9 are respectively provided by one. In FIG. 4, the waveforms at places ①-⑦ are shown.

With the ignition system "S", when the engine speed is low (refer to low engine speed of FIG. 4), the intervals between the firings of each engine cylinders are wide. So, in case the pulse generating circuit 6 outputs a high tension pulse 60 under low engine speed, the ignition timing of the next cylinder comes after the charge has been unloaded completely by ion current, thus making it unnecessary to consider the effect of the behavior of the ignition coil 1 on the detection of a misfire.

However, when the engine speed becomes higher (refer to high engine speed of FIG. 4), the ignition timing of the next cylinder comes before the charge is unloaded completely by ion current, so the effect of the behavior of the ignition coil 1 on the detection of a misfire results.

More specifically, when the high tension pulse 60 is output to the ignition coil 1 of the #1 cylinder and the timing of energization of the ignition coil 1 of the #2 cylinder comes before the charge is unloaded completely, a high voltage of a polarity reverse to that at the time of ignition is caused in the secondary winding 12. That is, a positive voltage is caused at the secondary negative terminal 122 side, resulting in that the potential at the cathode 71 side of the diode 7 increases and a high voltage at the cathode 71 side is maintained during the energization of the ignition coil 1. As a result, even in case of normal combustion, i.e., normal firing, a long pulse (waveform at the place 7 at high speed in FIG. 4) is produced, thus causing the engine control unit to make an erroneous judgment that a misfire has occurred.

Thus, in the single-ended distributorless ignition system "A" according to an embodiment of the present invention, one diode 7 and one voltage dividing circuit 8 are provided to every two ignition coils 1 and connections thereof are made as shown in FIG. 1, whereby the reverse polarity of the high voltage at the time of engergization of each ignition coils 1 does not cause any effect on the detecting places located at the secondary negative terminal 122 sides of other ignition coils 1.

Figure 2:
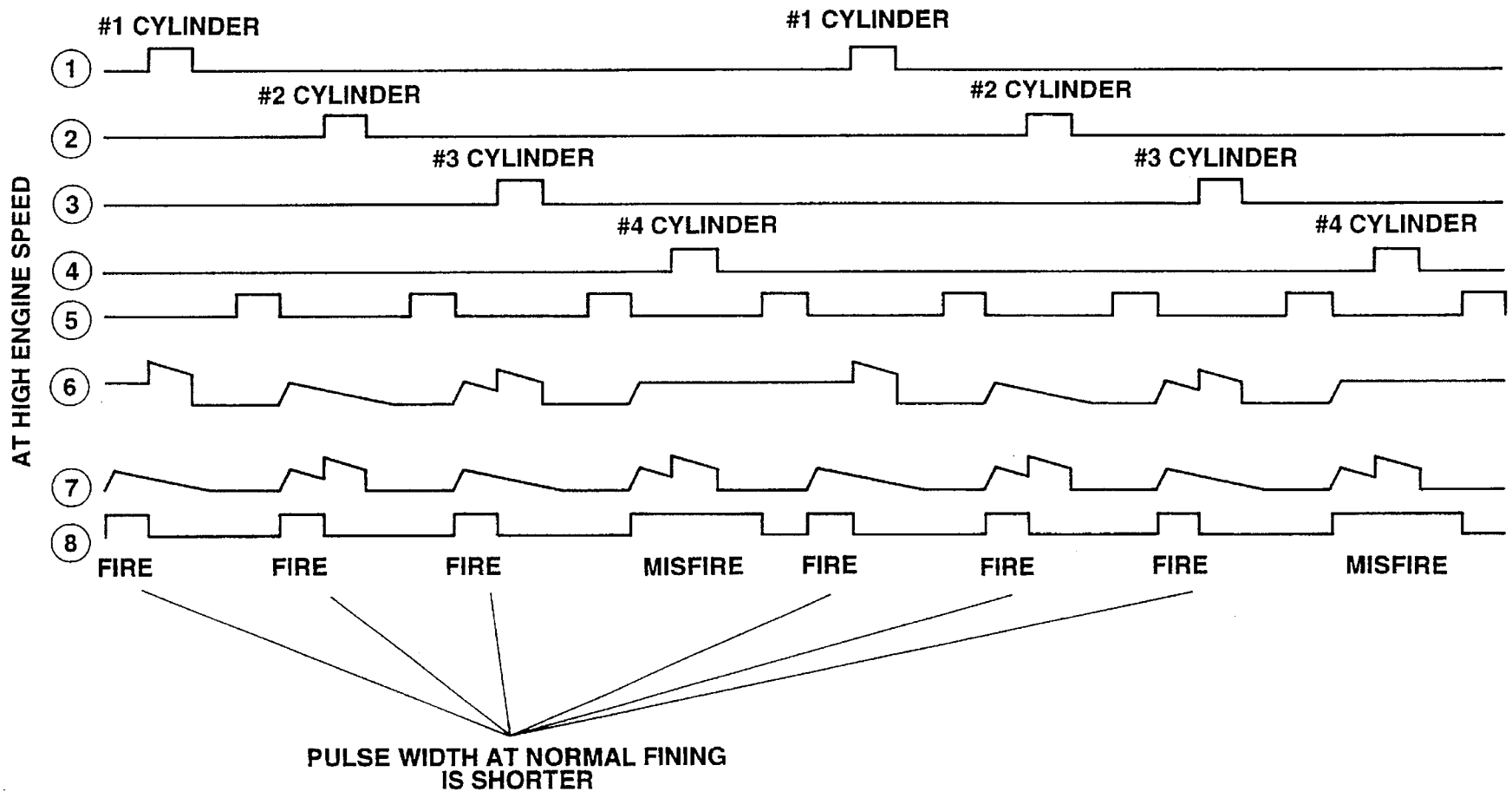
FIG. 2 is a chart of output waveforms at various portions of the single-ended distributorless ignition system of FIG. 1.

Due to this, even at high engine speed, the above described disadvantage is not caused, allowing, as shown in the waveform at the place ⑧ in FIG. 2, a small width pulse to be output at the time of ignition and thus making it possible to detect a misfire at high engine speed assuredly (advantage "a").

The present invention has further advantages as follows.

(b) The high tension pulse 60 is transmitted through each diode 7 to the secondary negative terminal 122 of the secondary winding 12 of each ignition coil 1 and then through each secondary winding 12, secondary high tension positive terminal 121, high tension cable, erroneous ignition preventing diode 51 to the center electrode of each spark plug 52. The attenuation of the high tension pulse 60 applied to each spark plug 52 is transmitted through the reverse order to the cathode 71 sides of the diodes 7.

Due to this, it becomes possible to detect a misfire at each engine cylinder through detection of a potential variation at the cathodes 71, so the number of the detection condenser 81 of the voltage dividing circuit 8 in the signal-ended distributorless ignition system "A" having a combustion condition or misfire detecting device can be two.

(c) Since each diode 7 is connected at the cathode 71 side thereof to the condenser 81, the pulse generating circuit 6, voltage dividing circuits 8 and diodes 7 can be united into one or two units. The condenser 81 is simple in structure and is not required to have an ability of withstanding a high voltage as compared with the prior art coupling condensers 914, 915, 916 and 917 and the condenser 918.

Figure 5:
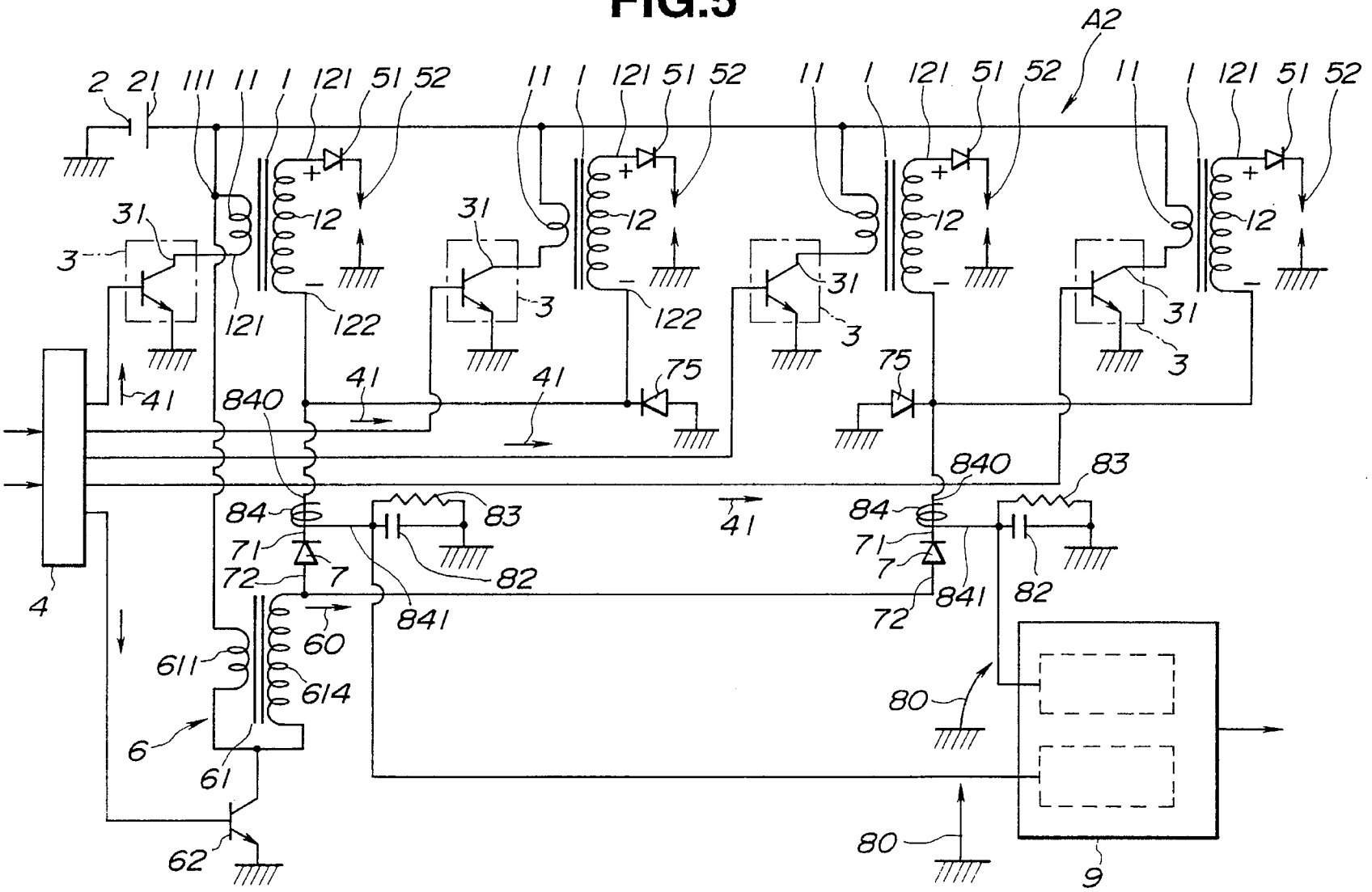
FIG. 5 is a diagram of a single-ended distributorless ignition system equipped with a misfire detecting device according to a second embodiment of the present invention.

FIG. 5 shows a second embodiment of the present invention. The single-ended distributorless ignition system "A2" having incorporated therein a misfire detecting detecting device of this embodiment differs from the first embodiment of FIGS. 1 and 2 in the following respects.

The capacitors 84 are composed of wires 841 wound around the connection lines 840 connecting between the cathode 71 sides of the diodes 7 and the secondary negative terminals 122 of the secondary winding 12 and thereby constructed so as to attain a small capacity (about 3 pF). By this, the single-ended distributorless ignition system "A2" having incorporated therein a misfire detecting device according to the second embodiment has a following advantage.

(d) Since the capacitors 84 are employed in place of the small capacity condensers 81, the cost for the condensers 81 becomes unnecessary, thus making it possible to reduce the manufacturing cost.

Figure 6:
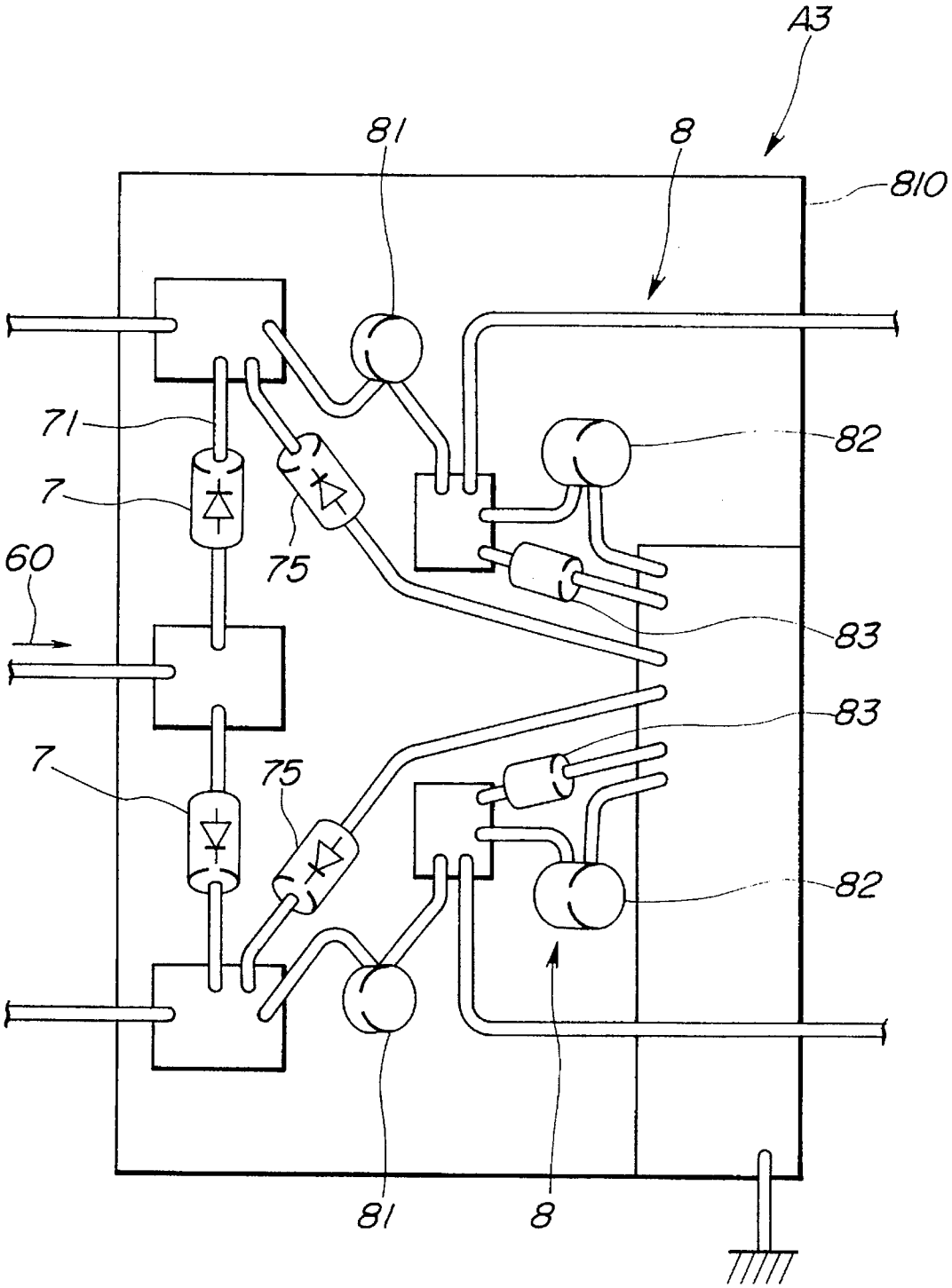
FIG. 6 is a top plan view of a wiring board according to the third embodiment of the present invention.

Referring to FIGS. 1 and 6, a third embodiment will be described.

As shown in FIGS. 1 and 6, a misfire detecting device of this embodiment incorporated in the single-ended distributorless ignition system "A3" differs from the first embodiment in that the condensers 81, condensers 82, diodes 7, diodes 75 and resistors 83 are formed on a single common substrate 810 made of glass epoxy. The number of the each parts of the voltage dividing circuits 8 is the same as that of the first embodiment.

This embodiment has, in addition to the above described advantages (a), (b) and (c), the following advantage.

(c) Since the condensers 81 and 82, diodes 7 and 75, etc. are arranged all together on the one substrate 810, it becomes possible to reduce the space occupied by the signal-ended distributorless ignition system "A3" and improve the ability of maintenance thereof.

Figure 7:
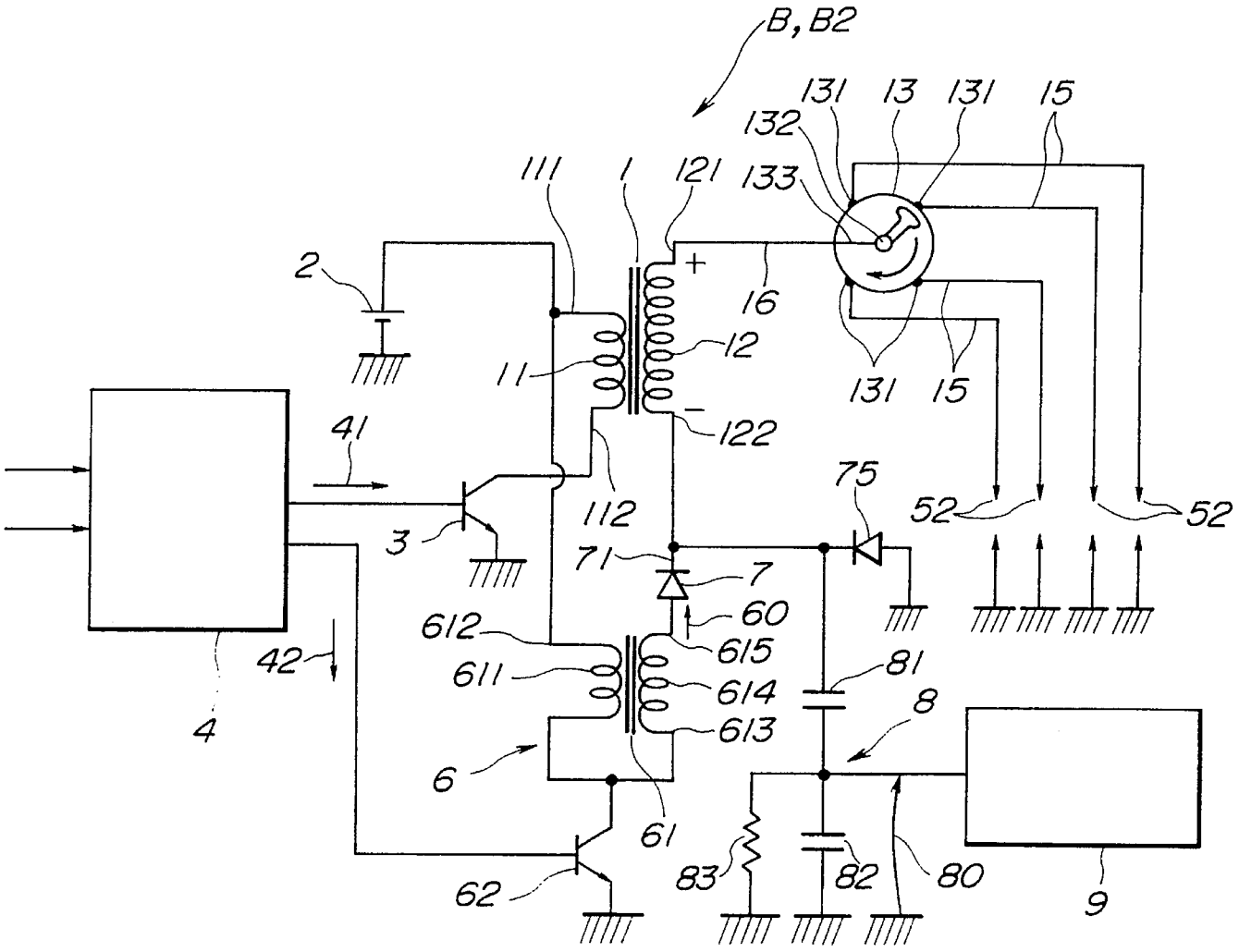
FIG. 7 is a wiring diagram of a distributor type ignition system equipped with a misfire detecting device according to a fourth or fifth embodiment of the present invention.

Referring to FIG. 7, a fourth embodiment of the present invention will be described.

The distributor type ignition system "B" having incorporated therein a misfire detecting device of this embodiment (for use in four-cylinder gasoline engine) includes an ignition coil 1, a battery 2 connected to a primary winding 11, a power transistor 3, an engine control unit (ECU) 4 for delivering an ignition signal 41 to the power transistor 3, distributor 13, spark plugs 52 for connection with a side electrode 131 side of the distributor 3, a pulse generating circuit 6 for generating a high tension pulse 60, a diode 7 for connection between the secondary terminal 615 and the secondary negative terminal 122, a voltage dividing circuit 8 for dividing the potential on the cathode 71 side of the diode 7, and a misfire detecting circuit 9 for receiving a divided voltage 80.

The high voltage generated at the ignition coil 1 is transmitted though a center code 16 to a center electrode 133, then applied from a center contact piece (not shown) to a rotor 132, and distributed through side electrodes 131 and by means of high tension cables 15 to the spark plugs 52.

An engine control unit (ECU) 4 determines an optimum ignition timing on the basis of engine speed, coolant temperature and various signals from a cam position sensor, etc., and delivers an ignition signal 41. Then, just when the rotating rotors 132 comes to face the side electrodes 131 connected with the spark plugs 52, a high voltage is generated at the ignition coil 1.

While there is a gap of about 0.5 mm between the fan-shaped end of the rotor 132 and the side electrodes 131, not only the high voltage for ignition but the high tension pulse 60 goes over the gap with a quite small loss and reaches the spark plugs 52.

In case of a four-cycle engine, one ignition process comes to every two revolutions of a crankshaft. So, the gear ratio of the rotor 132 of the distributor 13 is determined so that one revolution of the rotor 132 occurs to every two revolutions of the engine crankshaft.

Then, the advantages of this embodiment will be described.

(f) The high tension pulse 60 is transmitted through the diode 7, the secondary negative terminal 122 of the secondary winding 12 of the ignition coil 1, secondary high tension positive terminal 121, the rotor 132 of the distributor 13 and the side electrodes 131 of the distributor 13, and applied to the spark plugs 52. The attenuation variation of the high tension pulse 60 applied to the spark plugs 52 is transferred in the reverse order to the cathode 71 of the diode 7.

Due to this, by detecting the potential variation at the cathode 71 of the diode 7, it becomes possible to detect a misfire of each engine cylinders having installed therein the spark plugs 52, so the distributor type ignition system "B" having a misfire detecting device can reduce the detection condenser 81 of the voltage dividing circuit 8 to one.

(g) In this embodiment, the condenser 81 is connected to the cathode 71 side of the diode 7, so it becomes possible to unite the pulse generating circuit 6, diode 7, and voltage dividing circuit 8 into a single unit. The condenser 81 is simple in structure as compared with the prior art coupling condensers 914, 915, 916, 917 and the condenser 918, and is not required to have an ability of withstanding a high voltage.

Figure 8:
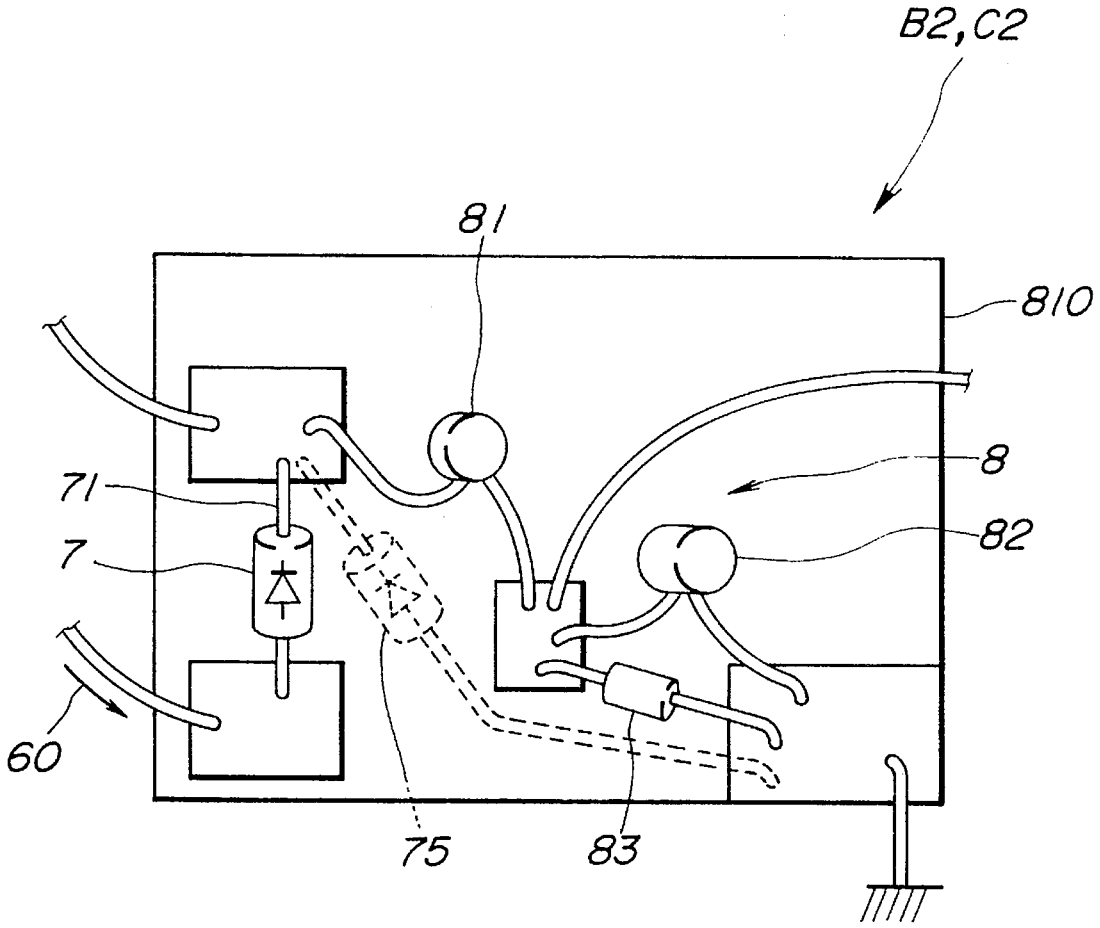
FIG. 8 is a top plan view of a wiring board according to the fifth or a seventh embodiment of the present invention.

Referring to FIGS. 7 and 8, a distributor type ignition system "B2" having incorporated therein a misfire detecting device according to a fifth embodiment will be described. This embodiment differs from the fourth embodiment in that the condensers 81 and 82 and diodes 7 and 75 are formed on one common substrate 810 as shown in FIG. 8. The number of parts of each of the dividing circuits 8 is the same as that of the first embodiment.

This embodiment has, in addition to the advantages (f) and (g), the following advantages.

(h) Since the condensers 81, 82 and the diodes 7, 75 are installed all together on one substrate 810, it becomes possible to reduce the space occupied by the distributor type ignition system "B2" and improve the ability of maintenance.

Figure 9:
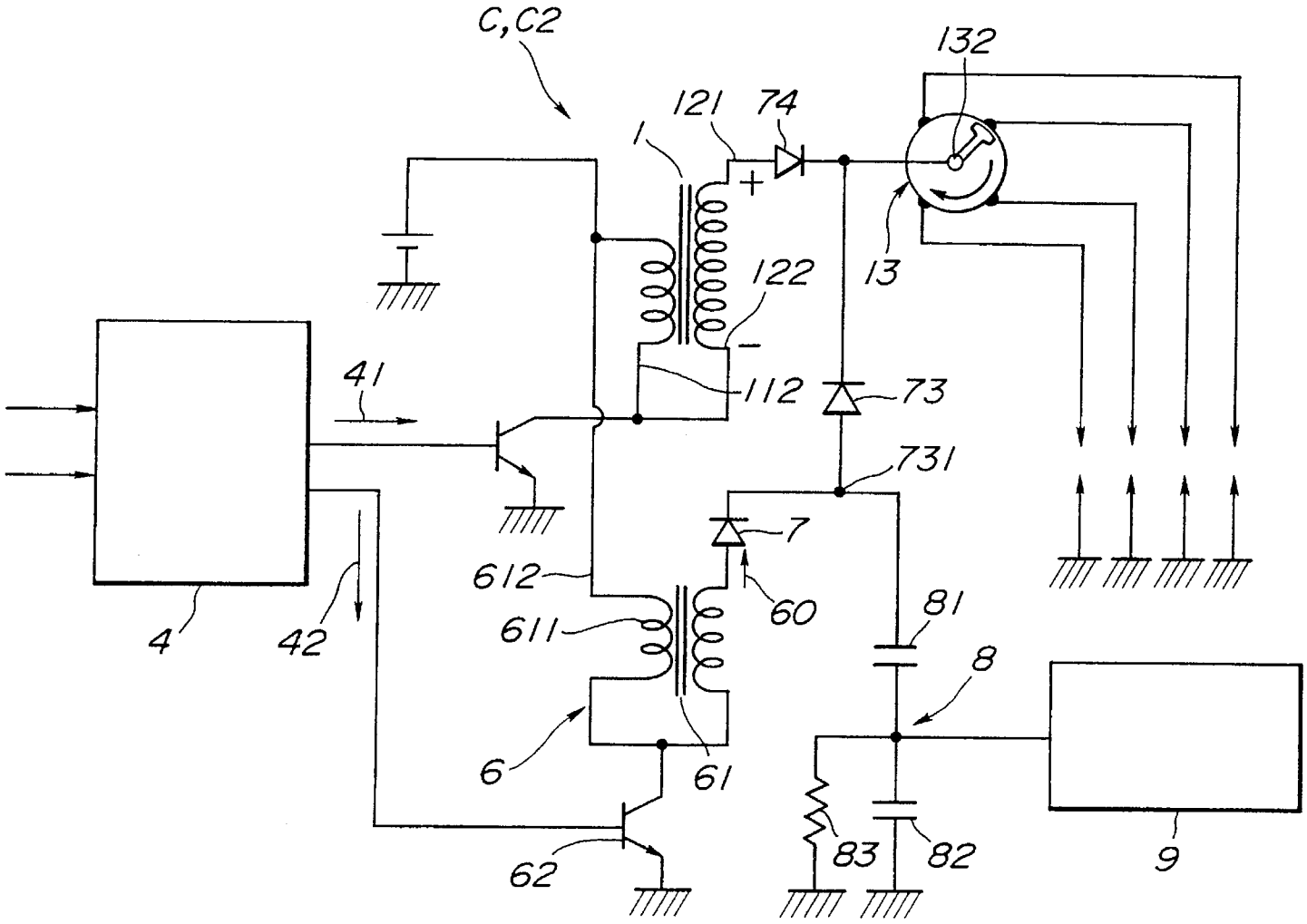
FIG. 9 is a wiring diagram of a distributor type ignition system equipped with a misfire detecting device according to a sixth or the seventh embodiment of the present invention.
Figure 10:
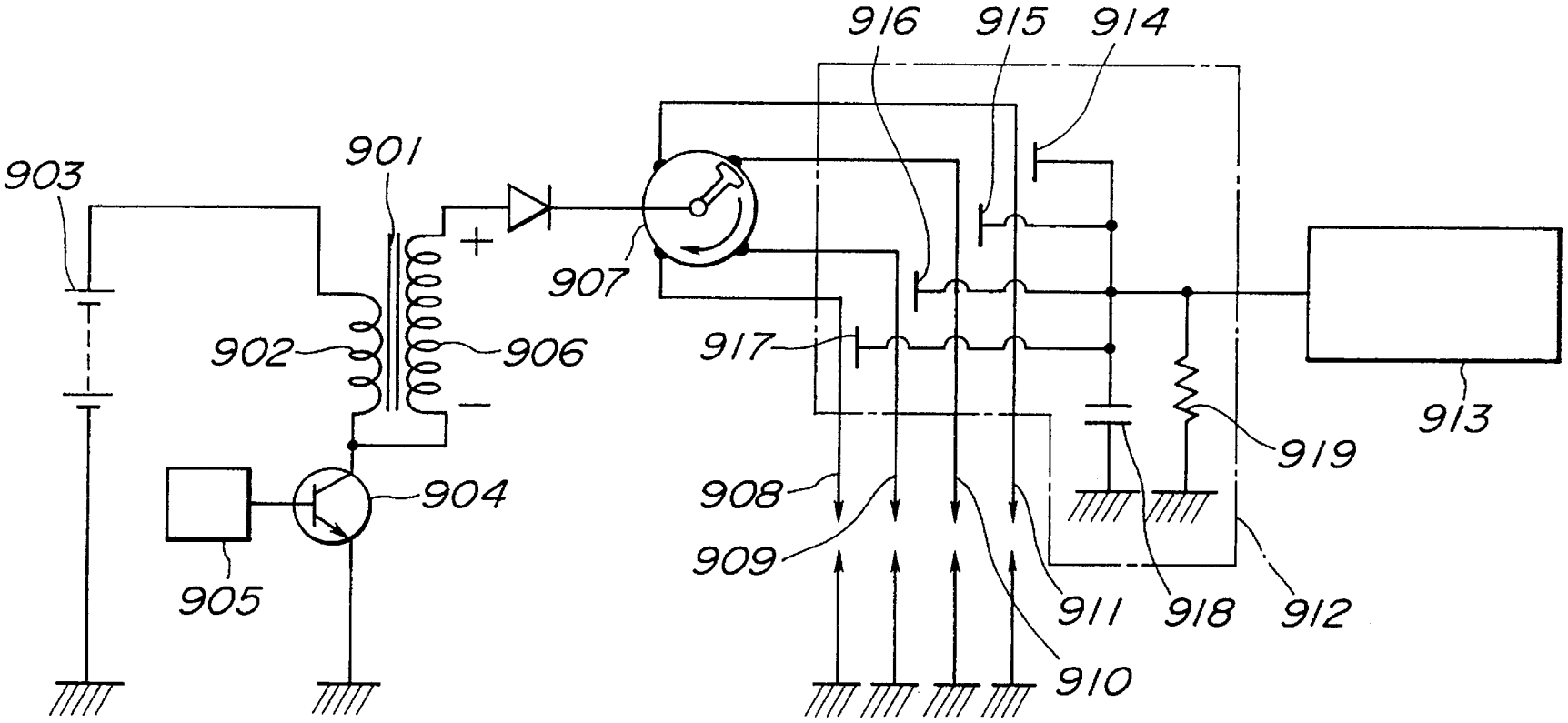
FIG. 10 (PRIOR ART)
FIG. 10 is a wiring diagram of a distributor type ignition system equipped with a prior art misfire detecting device.
Figure 11:
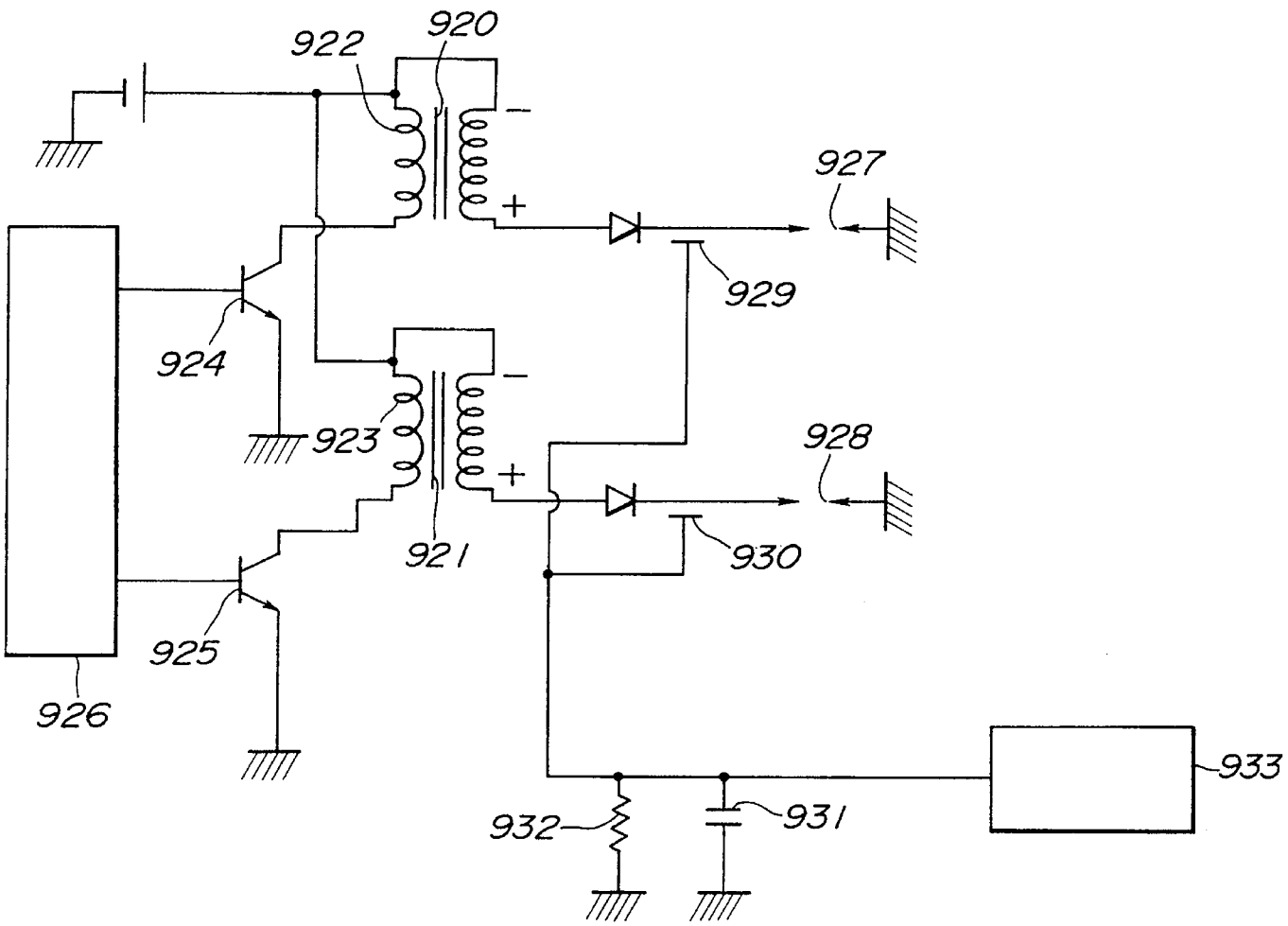
FIG. 11 (PRIOR ART)
FIG. 11 is a wiring diagram of a distributorless ignition system equipped with a prior art misfire detecting device.

Referring to FIGS. 9, a distributor type ignition system "C" having incorporated therein a misfire decting device according to a sixth embodiment of the present invention will be described.

The distributor type ignition system "C" (for four-cylinder gasoline engine) is constructed such that the secondary negative terminal 122 and the primary terminal 112 are connected to each other, the secondary high tension positive terminal 121 is connected through the diode (first reverse current preventing diode) 74 to the rotor 132 of the distributor 13, and the high tension pulse 60 is applied through the diode (i.e., second reverse current preventing diode) 7 and diode (i.e., leakage preventing diode for preventing approach of a high voltage for ignition) 73 to the rotor 132 of the distributor 13. The voltage, dividing circuit 8 divides the voltage at the junction 731 between the above described diodes 7 and 73.

The misfire detecting device of this embodiment incorporated in the distributor type ignition system "C" has the following advantages.

(i) The number of the detection condenser 81 of the voltage dividing circuit 8 can be one. Further, the condenser 81 is simple in structure as compared with the prior art coupling condensers 914, 915, 916, 917 and the condenser 918, and is not required to have an ability of withstanding a high voltage.

Referring to FIGS. 8 and 9, a distributor type ignition system "C2" having incorporated therein a misfire detecting device according to a seventh embodiment will be described.

The distributor type ignition system "C2" differs from the fifth embodiment in that the condensers 81, 82 and the diodes 7, 75 are arranged all together on one substrate 810 as shown in FIG. 9. The number of parts of each of the voltage dividing circuit 8 is the same as that of the first embodiment.

This embodiment has, in addition to the advantages (i), the following advantage.

(j) Since the condensers 81, 82 and the diodes 7, 75 are arranged all together on the one substrate 810, it becomes possible to reduce the space occupied by the distributor type ignition system "C2" and improve the ability of maintenance.

In the foregoing, it is to be noted that while this invention has been described and shown as being applied to a four-cylinder engine, this is not for the purpose of limitation but it can be applied to a multi-cylinder engine of any number of cylinders such as a six-cylinder engine, eight-cylinder engine.

It is to be further noted that when the diode 7 lacks the ability of withstanding a high voltage, a plurality of diodes may be connected in series to it.

It is to be further noted that the sending time, continuing time and voltage of the high tension pulse 60 can be determined suitably so long as it does not cause spark discharge.

It is to be further noted that the high voltage for causing spark discharge by a spark plug can be negative.

From the foregoing, it will be understood that in case of installing the misfire detecting device of this invention in a multi-cylinder internal combustion engine, the voltage for detecting occurrence of a misfire of each cylinder can be drawn from the passing side end of the reverse current prevent diode.

It will be further understood that in the misfire detecting device of the present invention the high tension pulse is applied through the reverse current preventing diodes (of the half the number of the ignition coils) to the other ends of the respective secondary windings of two ignition coils and then applied from one ends of the secondary windings to the center electrodes of each spark plugs. The attenuation of the high tension pulse applied to each spark plugs is transferred through the secondary windings to the other ends of same. Due to this, by detecting the potential variations at the cathode sides of each diodes, it be becomes possible to detect occurrence of a misfire of the spark plugs provided to each cylinders, so the voltage dividing means of the misfire detecting device for use in a single pole distributorless ignition system can be simplified in structure. Further, even at high engine speed, detection of a misfire can be attained with high accuracy.

It will be further understood that in the misfire detecting device according to one embodiment of this invention, the high tension pulse is applied through the reverse current preventing diodes, the other ends of the secondary windings of the ignition coils and one ends of same to the center electrodes of the spark plugs. The attenuation variations of the high tension pulse applied to each spark plugs is transferred in the reverse order to the other ends of the secondary windings of the ignition coils. Due to this, by detecting the potential variations at the cathode sides of each diodes, it becomes possible to detect occurrence of a misfire in each cylinders provided with the spark plugs, so the voltage dividing means of the misfire detecting device for use in a single-ended distributorless ignition system can be simplified in structure.

It will be further understood that in the misfire detecting device according a further embodiment of the present invention, the high tension pulse is applied through the second reverse flow preventing diodes, the leakage preventing diodes and the rotor side electrode of the distributor and is applied to the spark plugs. The attenuation variations of the high tension pulse applied to each spark plugs are transferred in the reverse order to the junctions between the second reverse current preventing diodes and the leakage preventing diodes. Due to this, by detecting the attenuation variations at the junctions, it becomes possible to detect a misfire in each cylinders, so the voltage dividing means of the misfire detecting device for use in a distributor type ignition system can be simplified in structure.

It will be further understood that by the use of a condenser voltage dividing circuit in which a capacitor of a relatively small capacity and a capacitor of a relatively large capacity are connected in series, the total voltage is divided in such a manner that a high voltage which is a positive polarity pulse and to be detected is a fraction of the total voltage and is included within an allowable input range of the misfire detecting means.

It will be further understood that by the use of a condenser voltage dividing circuit constructed of a first capacitor of a relatively small capacity electrically connected at one end to a junction between the other end of the secondary winding or the second reverse current preventing diode and leakage preventing diode, and a second capacitor of a relatively large capacity connected at one end to the other end of the first capacitor and grounded at the other end, and the first and second capacitors are installed on one common insulation substrate, the condenser voltage dividing circuit can be arranged as a unit on a single insulation substrate and it becomes possible to reduce the space occupied by the misfire detecting device and improve the ability of maintenance. Further, it becomes possible to divide the total voltage at the other ends of the secondary windings or the junctions between the second reverse current preventing diodes and the leakage preventing diodes to which a positive polarity pulse is applied in such a manner that the derided voltage is included within an allowable input range of the misfire detecting means.

What is claimed is:

1. A method of detecting a misfire of an ignition system for inducing an ignition high voltage in a secondary winding of an ignition coil by intermittently supplying primary current to a primary winding of the ignition coil and applying the ignition high voltage to spark plugs provided for respective cylinders of a multi-cylinder internal combustion engine, comprising the steps of:

applying, after completion of spark discharge, a high tension pulse having a voltage level lower than that required for spark discharge to each of said spark plugs by way of a reverse current preventing diode and said secondary winding; and detecting a misfire at each of said cylinders on the basis of a voltage attenuation characteristic at a passing side end of said reverse current preventing diode.

2. A misfire detecting device for a single-ended distributorless ignition system having ignition coils of the same number as cylinders of an engine and each having a primary winding and a secondary winding independent from the primary winding, primary current supplying means for supplying battery current to the primary winding of the ignition coils intermittently and in turn, and spark plugs provided for respective cylinders of the engine and each connected at a center electrode side to one end of the secondary winding and grounded at an outer electrode side to a cylinder side, the misfire detecting device comprising:

pulse generating means for generating a high tension pulse having a voltage level lower than that required for spark discharge after completion of spark discharge of one of the spark plugs and before application of an ignition high voltage to another of the spark plugs which is to discharge next;

reverse current preventing diodes of half the number of the ignition coils and each connected at a cathode to a junction between the other ends of each secondary windings of two of the ignition coils which cause ignition at a phase difference of 360° with respect to an engine crank angle end at an anode to an output end of said pulse generating means;

voltage dividing means of half the number of the ignition coils for dividing a voltage at a cathode side of each of said diodes to obtain a divided voltage thereat; and detecting means for detecting a misfire of the ignition system on the basis of an attenuation characteristic of said divided voltage after application of said high tension pulse.

3. The device according to claim 2, wherein said voltage dividing means comprises a condenser voltage dividing circuit constructed of a capacitor of a relatively small capacity and a capacitor of a relatively large capacity which are connected in series.

4. The device according to claim 2, wherein said voltage dividing means comprises a condenser voltage dividing circuit constructed of a first capacitor of a relatively small capacity electrically connected at one end to a junction between the other end of said secondary winding and a corresponding one of said reverse current preventing diodes, and a second capacitor of a relatively large capacity connected at one end to the other end of said first capacitor and grounded at the other end, said first and second capacitors being installed on one common insulation substrate.

5. A misfire detecting device for an ignition system having an ignition coil having a primary winding and a secondary winding independent from the primary winding, primary current supply means for intermittently supplying battery current to the primary winding of the ignition coil, a distributor connected at a rotor side to one end of the secondary winding, and a spark plug provided for a cylinder of an engine and connected at a center electrode side to a side electrode of the distributor and grounded at an outer electrode side to a cylinder side, the misfire detecting device comprising:

pulse generating means for generating a high tension pulse having a voltage level lower than that required for spark discharge just after completion of spark discharge of said spark plug;

a reverse current preventing diode through which said high tension pulse is applied to the other end of said secondary winding;

voltage dividing means for dividing a voltage at said other end of said secondary winding to obtain a divided voltage thereat; and detecting means for detecting a misfire on the basis of an attenuation characteristic of said divided voltage after application of said high tension pulse.

6. The device according to claim 5, wherein said voltage dividing means comprises a condenser voltage dividing circuit constructed of a capacitor of a relatively small capacity and a capacitor of a relatively large capacity which are connected in series.

7. The device according to claim 5, wherein said voltage dividing means comprises a condenser voltage dividing circuit constructed of a first capacitor of a relatively small capacity electrically connected at one end to a junction between the other end of said secondary winding and said reverse current preventing diode, and a second capacitor of a relatively large capacity connected at one end to the other end of said first capacitor and grounded at the other end, said first and second capacitors being installed on one common insulation substrate.

8. A device for detecting a misfire of an ignition system having an ignition coil having a primary winding and a secondary winding, primary current supplying means for intermittently supplying battery current to the primary winding of the ignition coil, a distributor connected at a rotor side to one end of the secondary winding, and a spark plug connected at a center electrode side to a side electrode of the distributor and grounded at an outer electrode side to a cylinder side, the device comprising:

a first reverse current preventing diode disposed between said one end of said secondary winding and said rotor side of said distributor;

pulse generating means for generating a high tension pulse having a voltage level lower than that required for spark discharge just after completion of spark discharge of said spark plug;

a second reverse current preventing diode and leakage preventing diode through which said high tension pulse is applied to the distributor side of said distributor;

voltage dividing means for dividing a voltage at a junction between said second reverse current preventing diode and said leakage preventing diode to obtain a divided voltage thereat; and a misfire detecting means for detecting a misfire on the basis of an attenuation characteristic of said divided voltage after application of said high tension pulse.

9. The device according to claim 8, wherein said voltage dividing means comprises a condenser voltage dividing circuit constructed of a capacitor of a relatively small capacity and a capacitor of a relatively large capacity which are connected in series.

10. The device according to claim 8, wherein said voltage dividing means comprises a condenser voltage dividing circuit constructed of a first capacitor of a relatively small capacity electrically connected at one end to a junction between the other end of said secondary winding and said leakage preventing diode, and a second capacitor of a relatively large capacity connected at one end to the other end of said first capacitor and grounded at the other end, said first and second capacitors being installed on one common insulation substrate.

11. A method of detecting a misfire of an ignition system for inducing an ignition high voltage in a secondary winding of an ignition coil by intermittently supplying primary current to a primary winding of the ignition coil and applying the ignition high voltage to spark plugs provided for respective cylinders of a multi-cylinder internal combustion engine, comprising the steps of:

applying, after completion of spark discharge, a high tension pulse having a voltage level lower than that required for spark discharge to each spark plug by way of a reverse current preventing diode and a leakage preventing diode for preventing ingress of an ignition high voltage; and detecting a misfire at each cylinder on the basis of a voltage attenuation characteristic at a passing side end of said reverse current preventing diode.

12. The device according to claim 8, wherein said voltage dividing means comprises a condenser voltage dividing circuit constructed of a first capacitor of a relatively small capacity electrically connected at one end to a junction between said second reverse current preventing diode and said leakage preventing diode, and a second end to the other end of said first capacitor and grounded at the other end, said first and second capacitors being installed on one common insulation substrate.

* * * * *